US006202373B1

(12) United States Patent
Lindgren

(10) Patent No.: US 6,202,373 B1
(45) Date of Patent: Mar. 20, 2001

(54) TOP-HUNG WINDOW

(75) Inventor: Claes Lindgren, Farum (DK)

(73) Assignee: Velux Industri A/S, Soborg (DK)

( * ) Notice: Subject to any disclaimer, the term of this patent is extended or adjusted under 35 U.S.C. 154(b) by 0 days.

(21) Appl. No.: 09/297,043

(22) PCT Filed: Nov. 13, 1997

(86) PCT No.: PCT/DK97/00514

§ 371 Date: Apr. 28, 1999

§ 102(e) Date: Apr. 28, 1999

(87) PCT Pub. No.: WO98/22685

PCT Pub. Date: May 28, 1998

(30) Foreign Application Priority Data

Nov. 19, 1996 (DK) ..... 1317/96

(51) Int. Cl.[7] ..... E04B 7/18
(52) U.S. Cl. ..... 52/200; 52/19; 52/72
(58) Field of Search ..... 52/200, 69, 72

(56) References Cited

U.S. PATENT DOCUMENTS

| | | | | |
|---|---|---|---|---|
| 2,909,254 | * | 10/1959 | Hallock | 52/200 X |
| 4,987,705 | * | 1/1991 | Sampson et al. | 52/200 X |
| 5,103,603 | * | 4/1992 | Verby et al. | 52/200 X |
| 5,207,036 | * | 5/1993 | Sampson et al. | 52/200 X |
| 5,669,186 | * | 9/1997 | Verby et al. | 52/200 X |

FOREIGN PATENT DOCUMENTS

| | | |
|---|---|---|
| 430138 | 8/1967 | (CH) . |
| 30 48 961 A1 | 7/1982 | (DE) . |
| 0 410 369 A2 | 1/1991 | (EP) . |
| 406787 | 2/1979 | (SE) . |
| WO 93/11332 | 6/1993 | (WO) . |

* cited by examiner

*Primary Examiner*—Christopher T. Kent
(74) *Attorney, Agent, or Firm*—Venable; John P. Shannon

(57) ABSTRACT

A window comprising a frame structure and a relative to the frame structure openable, top-hung sash structure with an insulating pane (4), a pivoting hinge provided at the top members (1, 5) of the frame and sash structures, the axis of which pivoting hinge is defined by engagement between a hook member (39) integral with the metal sheet profile of the sash top member and a hinge pin forming member (38) of a fitting member (37) connected with the frame top member, the hook member (39) being substantially V-shaped and the fitting member (37) substantially L-shaped. For maintaining the engagement between the hook member and the hinge pin forming member securing means in the form of holding means (40, 41) are provided, which are fastened to at least one adjacent pair of the side members (2, 6) of the frame and sash structures at a comparatively short distance from the axis of the pivoting hinge and which hold the V-shaped hook member (39) and said hinge pin forming member (38) in mutual engagement, but which, when turning the sash structure beyond said opening angle range, allow removal of the sash structure from the frame structure.

6 Claims, 5 Drawing Sheets

TOP-HUNG WINDOW

BACKGROUND OF THE INVENTION

The present invention relates to a window, in particular for mounting in an inclined roof surface, comprising a frame structure with top, bottom and side members and a relative to the frame structure openable, top-hung sash structure with an insulating pane enchased between top, bottom and side members of metal sheet profiles with a substantially L-shaped cross-section with a first wall portion covering a narrow edge zone of the exterior surface of the insulating pane and a second wall portion extending substantially in parallel with an edge surface of the insulating pane, a pivoting hinge provided at the top members of the frame and sash structures, the axis of which pivoting hinge is defined by engagement between a hook member integral with said second wall portion of the metal sheet profile of the sash top member and a hinge pin forming member of a fitting member connected with the frame top member, as well as securing means for maintaining the engagement between the hook member and the hinge pin forming member within a predetermined range of opening angle for the sash structure.

A window of this type is known from EP-A-0 410 369 and from international patent application No. WO93/11332. In these windows the entire sash structure and the fitting member connected with the frame top member are manufactured as extruded profiles. In the first-mentioned window the hinge members are constituted by a curved upward protrusion on the frame top member and a gasket placed in a downwards open groove in the sash top member and are permanently engaged without any possibility of disengagement, the movement of the sash top member being limited by adjacent parts of the frame top member or a superjacent sash profile. In the latter window the securing means comprise a block which is displaceably positioned in a groove in a sash side member and which may serve partly as an anchoring element for a locking member fastened in the frame structure in case of a not openable window, partly for releasable coupling with an operating arm in case of an openable window.

In consideration of the release of this coupling by manual operation, said block should normally be placed at a considerable distance from the pivoting hinge at the frame and sash top members, which on account of tolerances in the coupling members does not give full safety against unintentional release of the coupling. Furthermore, each release of the coupling, also within the opening angle range, will make it possible to dismount the sash relative to the frame.

SUMMARY OF THE INVENTION

It is the object of the invention to provide a window of the type mentioned by way of introduction, said window having a less complicated construction in respect of the design of the sash structure, the hinge itself and the securing means for maintaining the engagement between the members of the pivoting hinge and having an improved safety against unintentional release of the sash for dismounting.

This object is according to the invention met by a window which is characterized in that said hook member is substantially V-shaped with a first portion extending substantially perpendicular to the second wall portion, and a second portion angular relative thereto, that the fitting member is substantially L-shaped and that the hinge pin forming member in the closed position of the window abuts said first portion of the V-shaped hook member, and that said securing means are constituted by holding means, which are fastened to at least one adjacent pair of the side members of the frame and sash structures at a comparatively short distance from the axis of the pivoting hinge, and which in an opening angle range which, calculated from the closed position, is smaller than the opening angle of the V-shaped hook member, hold the V-shaped hook member and said hinge pin forming member in mutual engagement, but which, when turning the sash structure beyond said opening angle range, allow removal of the sash structure from the frame structure.

This design makes it possible to manufacture all parts of the sash structure and the hinge by means of simple bending operations, and the holding means provide a safe securing of the engagement.

The opening angle of the V-shaped hook member preferably lies within the range of 20 to 30°.

The holding means are according to an embodiment of the invention constituted by blocks with part-cylindrical guide surfaces with axis in the pivot axis of the hinge.

In an embodiment of the invention a window operator is with a view to opening the sash structure to a ventilation position within said opening angle range mounted in connection with the bottom members of the frame and sash structures, which operator in addition to opening the window also holds the sash within the angular range, in which the securing means hold the hinge members in engagement with each other.

The operator may be an electrically driven chain operator with an operating chain detachably connected with the bottom member of the sash structure.

The invention will be explained in the following with reference to an embodiment as shown in the accompanying drawing, in which

DETAILED DESCRIPTION OF THE INVENTION

Figure 1:
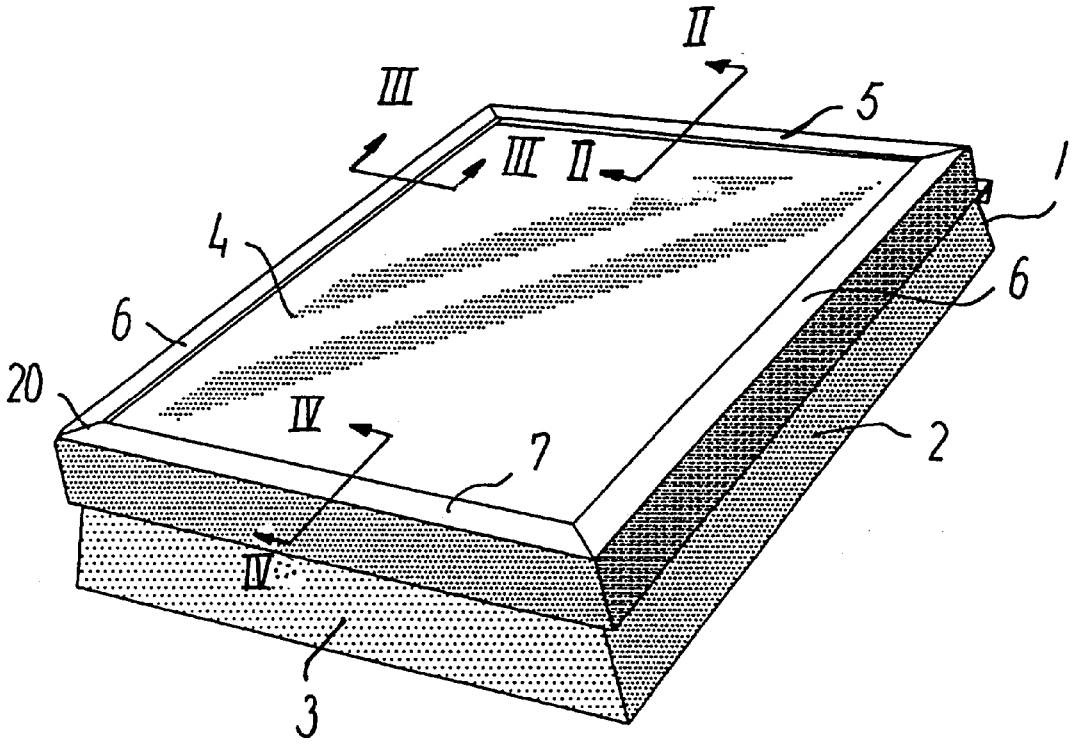
FIG. 1 is a perspective view of a top-hung window to be mounted in an inclined roof surface.

In the embodiment shown in the drawings, a top-hung roof or skylight window according to the invention comprises a frame structure having a top member 1, side members 2 and a bottom member 3 and a top-hung sash structure openable relative thereto, in which an insulating pane 4 is enchased between a top member 5, side members 6 and a bottom member 7.

Figure 2:
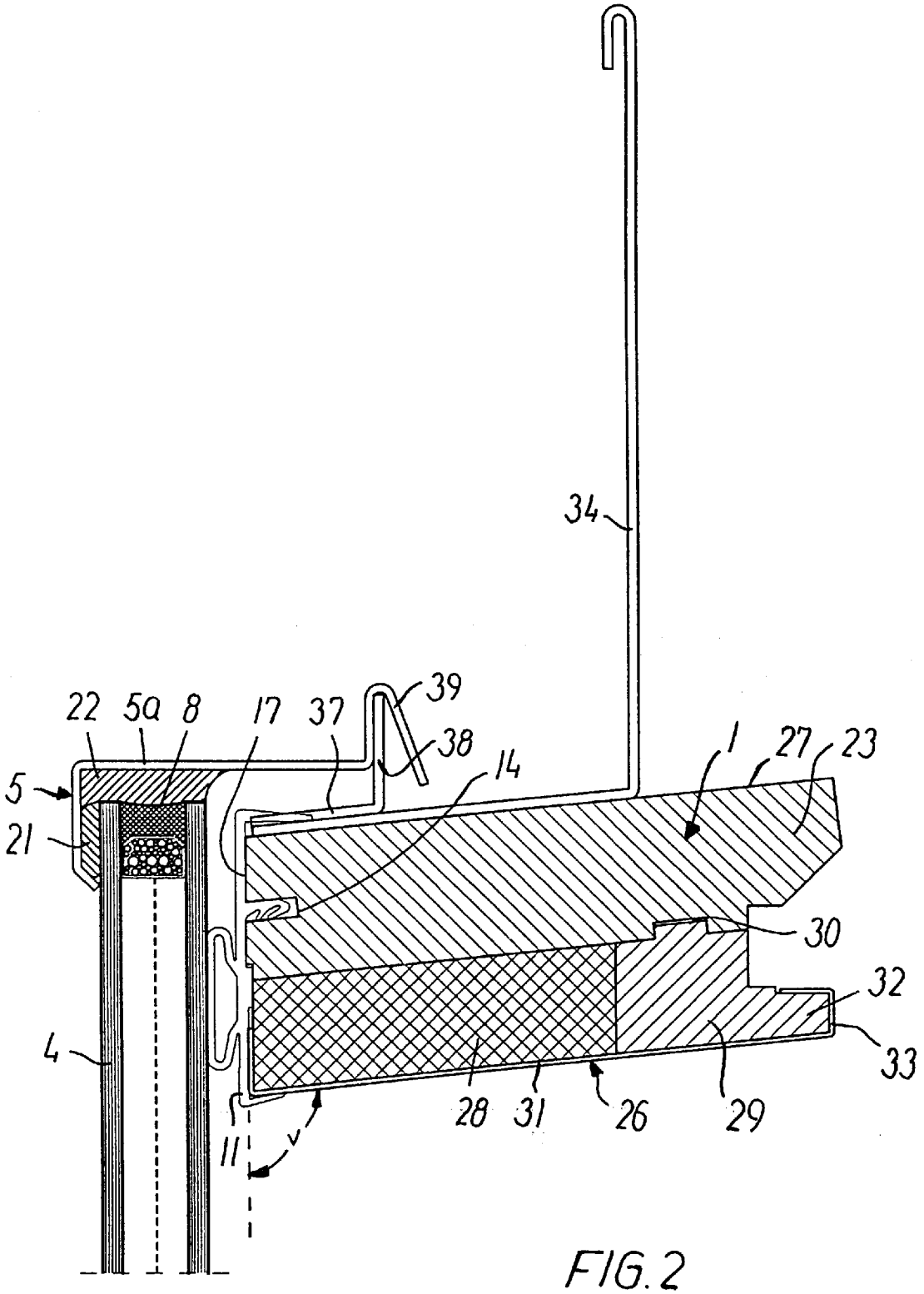
FIGS. 2, 3 and 4 show a cross-section of the top, side and bottom members of the frame and sash structures along the lines II—II, III—III and IV—IV in FIG. 1.
Figure 3:
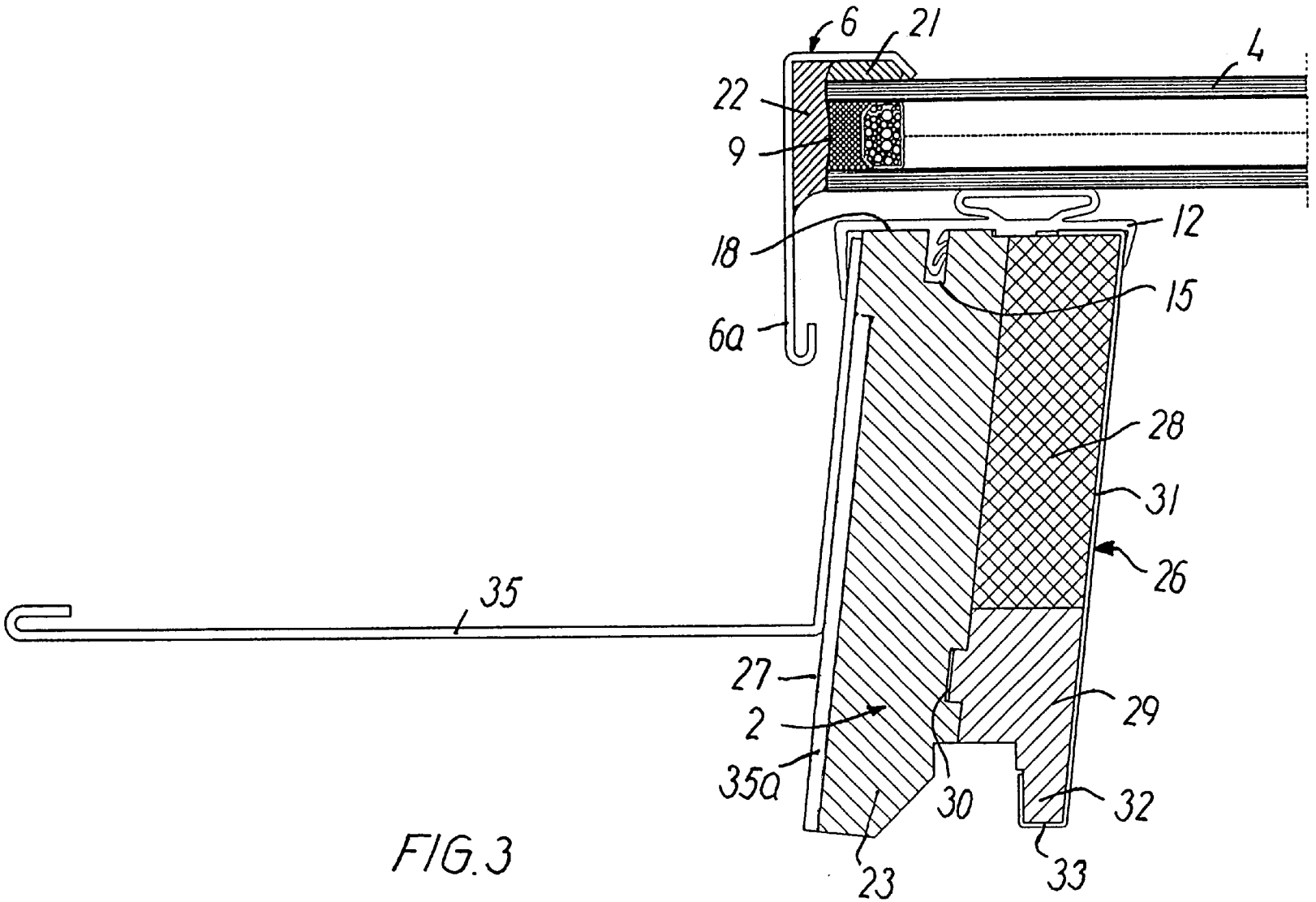
Figure 4:
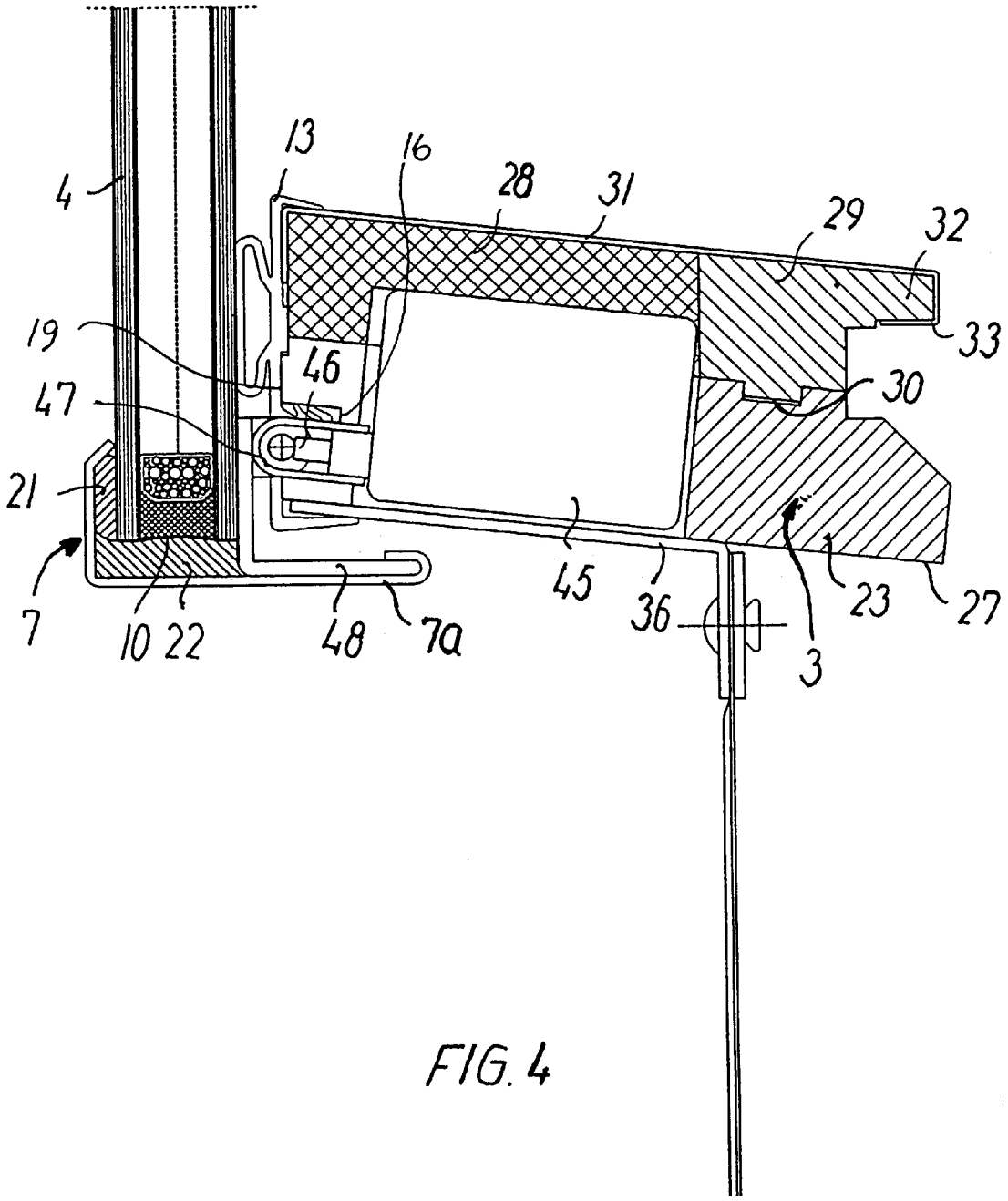

As will appear from the cross-sectional views in FIGS. 2–4, the insulating pane 4 is manufactured with dimensions which substantially correspond to the exterior measures of the frame structure, such that the edge surfaces 8–10 of the pane 4 are substantially flush with the exterior sides of the top, side and bottom members 1–3 of the frame structure, and such that the insulating pane 4 in the closed position of the window directly abuts resilient sealing profiles 11–13, which are retained in grooves 14–16 in exterior edge surfaces 17–19 of the top, side and bottom members 1–3 of the frame structure.

The sash profiles 5–7 are in the embodiment shown designed as metal sheet profiles with substantially L-shaped cross-section with a small wall thickness and mutually connected by corner joints 20, which, as shown in FIG. 1, may be made as 45° angular joints.

In this very simple and light sash structure, the insulating pane 4 is secured by an adhesive sealing, for instance, as shown, by joints 21 and 22 of silicone adhesive.

The wall 5*a*–7*a* of the L-shaped cross-section of the sash profiles 5–7, which abuts the edge surfaces 8–10 of the insulating pane 4, is, as shown, manufactured with such a width that in the closed position it overlaps the exterior side of the frame member 1–3 lying behind it and is at its interior edge folded for providing a softly rounded edge.

Figure 6:
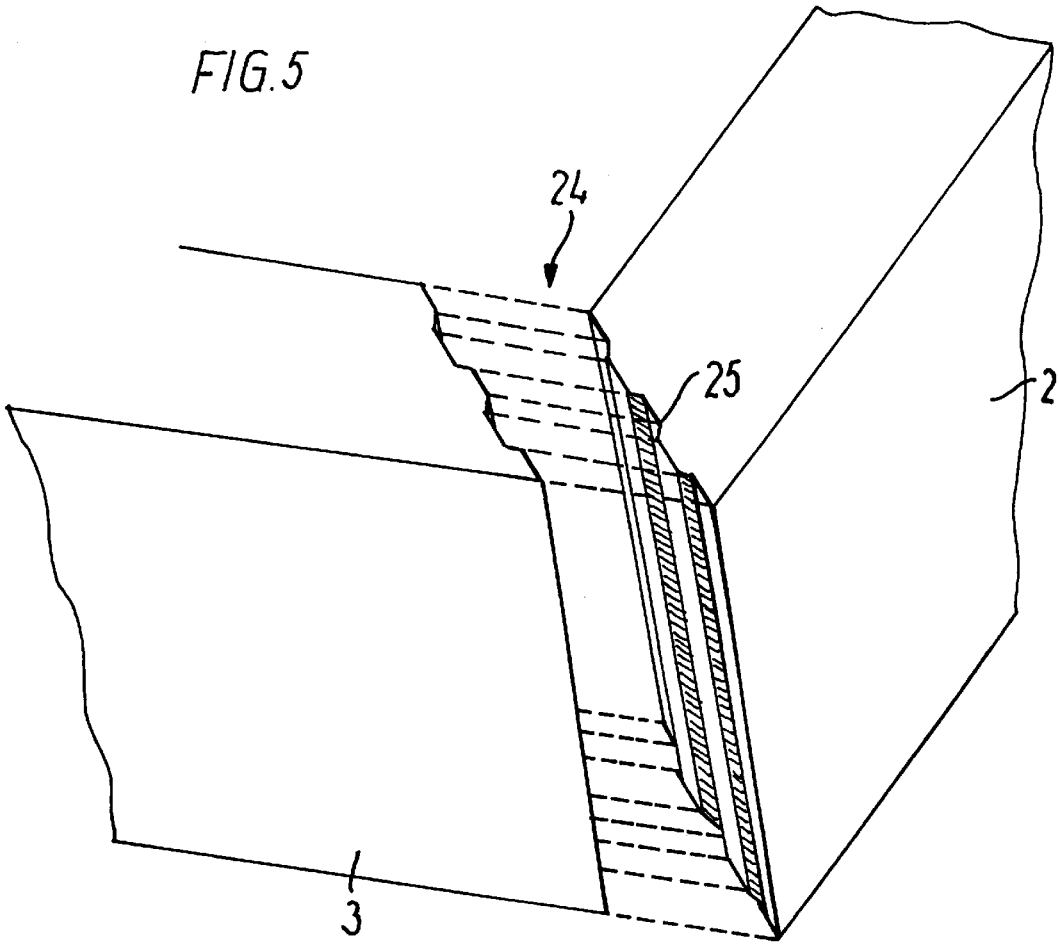

With a view to obtaining a good thermal insulation, the top, side and bottom members 1–3 of the frame are made from wood profiles 23, which, as shown in FIG. 6, are connected at the corners in profiled mitre joints 24, for instance with undulating abutment surfaces 25. This method of joining has the advantage that it partly provides a safe mutual locking of the top, side and bottom members 1–3, partly gives optimum insulating properties, the end surfaces of the wood profiles being removed from the exterior sides of the frame members.

In the embodiment shown, the frame wood profiles 23 are manufactured with a substantially parallelogram-shaped cross-section, in which the above-mentioned exterior edge surfaces 17–19 lie in a common plane, with which the adjacent opposite side surfaces 26, 27 of the profile cross-section form an angle v of for instance 95 to 140°, in the embodiment shown 96°. By this profile cross-section, which provides the structure with the shape of a low frustum of a pyramid, an advantageous possibility is obtained of manufacturing the frame structure with oblique interior sides, which is desirable with a view to mounting various forms of accessories like for instance roller blinds and insect nets, and with a minimum consumption of material, the profiles 23 being, as shown, manufactured with a comparatively small thickness.

In the embodiment shown, the thermal insulating property of the frame structures is improved by the fact that to the side of the profiles 23, which is intended for forming the interior side of the frame structure, additional, substantially rod-shaped insulating elements 28 are retained, which may be manufactured from a suitable, well insulating material.

As will be seen from FIGS. 2–4, the insulating elements 28 extend across a part of the width of the wood profiles 23 and are supported by abutment lists 29 connected with the wood profiles 23 by groove and tongue joints 30.

On the interior sides 26, the top, side and bottom members 1–3 of the frame structures end in a covering of metal sheet profiles 31, which covers the entire interior side and extends towards the edge area of the insulating pane 4. By this metal sheet covering such an improved heat transmission towards the insulating pane is obtained that in practice it has turned out to be possible to completely prevent condensation, something which otherwise frequently happens at the border areas of roof or skylight windows. The heat transmission typically has the effect that at a room temperature of 20° C. and an outdoor temperature of 0° C., a temperature of about 14° C. is obtained on the interior side of the insulating pane 4.

The fact that the abutment lists 29, as shown, are designed such that they at a distance from the wood profiles 23 form a nose portion 32, may be exploited for retaining the covering profile 31 by manufacturing it with a folded edge portion 33.

This design of the frame structure entails that the wood profiles 23 and the abutment lists 29 connected therewith may be releasably connected with the insulating elements 28 and the covering profiles 31, which can easily be exchanged for lacquering/change of colour or for mounting of fittings for accessories, and which entails a simple, and from an environmental point of view advantageous construction, which makes it possible at a subsequent dismounting to easily separate the frame structure into wood profiles, insulating elements and metal profiles with a view to reusing the materials to a high degree.

On the exterior sides the top, side and bottom members 1–3 of the frame structure are in a manner known per se covered by flashing profiles 34–36 of metal sheets.

For fastening of the window to the underlying roof structure grooves 35*a* have, as shown in FIG. 3, been provided in the frame side members 2 for receiving fixing angles or straps, which are subsequently secured to the roof structure.

The sash and frame constructions shown makes it in an advantageous manner possible to make the top hinge of the window integral with the top members 1 and 5 of the frame and sash structures, respectively.

For this purpose a fitting member 37 with a hinge pin forming member in the form of a projecting wall portion 38 may be connected with the flashing profile 34 for the frame top member 1, whereas a substantially V-shaped hook member 39 is made integral with the wall portion 5*a* of the L-shaped metal sheet profile for the sash top member 5, said hook member 39 being hinged on the upward wall portion 38 and having an opening angle in the range of 20 to 30°.

Figure 5:
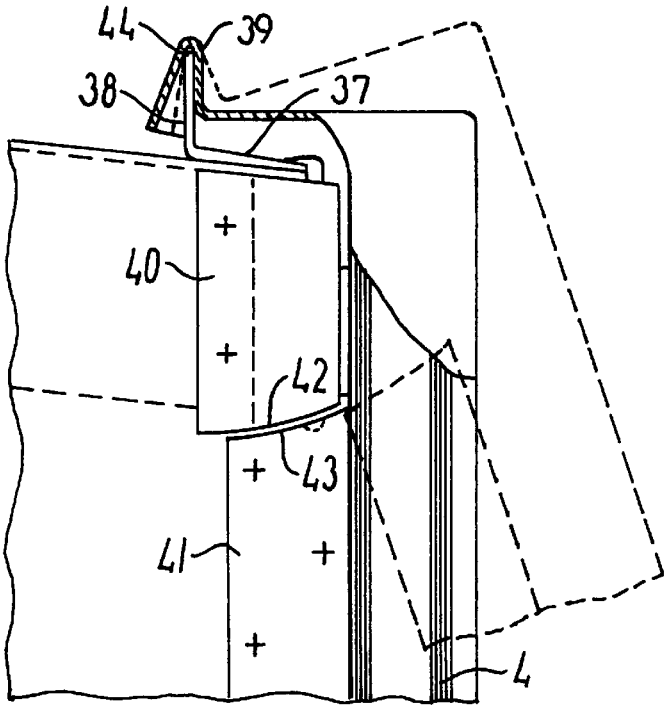
FIG. 5 shows the design of a top hinge for the window, a lateral and partially sectional view of the sash, and FIG. 6 the design of corner joints between the top, side and bottom members of the frame structure.

To hold the hook member 39 and the projecting wall portion 38 in mutual engagement and to make a turning of the sash structure to a ventilation position possible, securing means have, as shown in FIG. 5, been secured to adjacent pairs of side members 2 and 6 of the frame and sash structures, said securing means comprising, in the embodiment shown, holding means 40 and 41, for instance in the form of blocks of a wear-resistant plastic material, with part-cylindrical guide surfaces 42 and 43 with axis in the pivot axis of the hinge 44. Within an opening angle range, which is smaller than the opening angle of the V-shaped hook member 39, the holding means 40 and 41 will keep the hinge members 38 and 39 in mutual engagement, whereas they, when the sash structure is turned beyond this opening angle range to the position shown by a dotted line in FIG. 5, will be disengaged and thus allow an easy dismounting of the sash structure relative to the frame structure.

For opening the sash structure relative to the frame structure to a ventilation position within the opening angle range, a window operator may in a manner known per se be mounted in connection with the bottom members 3 and 7 of the frame and sash structures, for instance an electrically driven chain operator with an operator housing 45 accommodated in a recess in the wood profile 23 and the insulating element 28 and an operating chain 46, which may be detachably connected with a sash fitting 47 secured to a for instance L-shaped console 48 in connection with the L-shaped sash profile 7*a*, for instance secured to its folded edge portion.

What is claimed is:

1. A window, for mounting in an inclined roof surface, comprising a frame structure with top, bottom and side members (1–3) and a relative to the frame structure openable, top-hung sash structure with an insulating pane (4) encased between top, bottom and side members (5–7) of metal sheet profiles with a substantially L-shaped cross-section with a first wall portion covering a narrow edge zone of an exterior surface of the insulating pane (4) and a second wall portion **(5*a*–7*a*) extending substantially in parallel with an edge surface of the insulating pane, a pivoting hinge provided at the top members (1,5) of the frame and sash structures, the axis of which pivoting hinge is defined by engagement between a hook member (39) integral with said second wall portion (5*a*) of the metal sheet profile of the sash top member and a hinge pin forming member (38) of a fitting member (37) connected with the frame top member, as well as securing means for maintaining the engagement between the hook member and the hinge pin forming member within a predetermined range of opening angle for the sash structure, characterized in that said hook member (39) is substantially V-shaped with a first portion extending substantially perpendicular to the second wall portion (5*a*), and a second portion angular relative thereto, that the fitting member (37) is substantially L-shaped and that the hinge pin forming member (38) in the closed position of the window abuts said first portion of the V-shaped hook member (39), and that said securing means are constituted by holding means (40,41), which are fastened to at least one adjacent pair of the side members (2,6) of the frame and sash structures, and which in an opening angle range which, calculated from the closed position, is smaller than the opening angle of the V-shaped hook member, hold the V-shaped hook member (39) and said hinge pin forming member (38)** in mutual engagement, but which, when turning the sash structure beyond said opening angle range, allow removal of the sash structure from the frame structure.

2. The window according to claim 1, characterized in that the angle of opening of the V-shaped hook member (39) lies within the range of 20 to 30°.

3. The window according to claim 1 characterized in that with a view to opening the sash structure to a ventilation position within said opening angle range, a window operator is mounted in connection with the bottom members (3,7) of the frame and sash structures.

4. The window according to claim 3, characterized in that said operator is an electrically driven chain operator with an operating chain (46) detachably connected with the bottom member (7) of the sash structure.

5. The window according to claim 1 characterized in that said holding means (40,41) are constituted by blocks with part-cylindrical guide surfaces (42,43) with axis in the pivot axis (44) of the hinge.

6. The window as in claim 1 characterized in that the holding means is fastened to at least one adjacent pair of the side members of the frame and sash structures adjacent to the pivoting hinge.

* * * * *